US005690758A

United States Patent [19]

Oh et al.

[11] Patent Number: 5,690,758

[45] Date of Patent: Nov. 25, 1997

[54] PROCESS FOR THE FABRICATION OF ALUMINUM ALLOY SHEET HAVING HIGH FORMABILITY

[75] Inventors: Binrun Oh; Yuichi Suzuki; Kunihiko Kishino, all of Tokyo, Japan

[73] Assignee: Kaiser Aluminum & Chemical Corporation, Pleasanton, Calif.

[21] Appl. No.: 491,869

[22] PCT Filed: Dec. 28, 1994

[86] PCT No.: PCT/FR94/01547

§ 371 Date: Nov. 22, 1995

§ 102(e) Date: Nov. 22, 1995

[87] PCT Pub. No.: WO95/18244

PCT Pub. Date: Jul. 6, 1995

[30] Foreign Application Priority Data

Dec. 28, 1993 [JP] Japan ..... 5-352713

[51] Int. Cl.[6] ..... C22F 1/05; C22F 1/057

[52] U.S. Cl. ..... 148/700; 148/694; 148/698; 148/699; 148/701

[58] Field of Search ..... 148/694, 698, 148/699, 700, 701

[56] References Cited

U.S. PATENT DOCUMENTS 3,135,633 6/1964 Hornus .

5,098,490 3/1992 Huu ..... 148/12.7

5,582,660 12/1996 Erickson et al. ..... 148/688

FOREIGN PATENT DOCUMENTS 0 051 549 5/1982 European Pat. Off. .

OTHER PUBLICATIONS

Singleton, Jr., "Quench–Aging Makes Headway With 6061 Aluminum", The Iron Age, vol. 192, No. 24, Dec. 12, 1963, pp. 94,95.

*Primary Examiner*—David A. Simmons
*Assistant Examiner*—M. Alexandra Elve
*Attorney, Agent, or Firm*—Philip L. McGarrigle

[57] ABSTRACT

The invention relates to a fabrication process to obtain aluminum alloy sheet having high formability. In this process, an alloy obtained by alloying Al with Si, Mg, Cu, Mn and Fe, and one or more elements taken from the group of Cr, Zn, Zr and Ti, is subjected to a continuous solution treatment for at least 3 seconds at a temperature higher than 450° C., followed by cooling to a temperature between 60° and 250° C., at a rate higher than 100° C./min, followed by a coiling at the same temperature in the 60° C.–250° C. range and a preaging between 1 minute and 10 hours at the same cooling temperature of 60° to 250° C.

2 Claims, 1 Drawing Sheet

50nm

50nm

50nm

50nm

50nm

PROCESS FOR THE FABRICATION OF ALUMINUM ALLOY SHEET HAVING HIGH FORMABILITY

BACKGROUND OF THE INVENTION

1. Field of the Invention

The present invention relates to a fabrication process to improve the mechanical and forming properties of aluminum alloy sheet, used particularly in automotive bodies.

2. Description of the Prior Art

Automotive bodies are traditionally made from cold-rolled steel sheet.

In the past few years, auto manufacturers have attempted to reduce the weight of their models by studying the possibility of using aluminum alloy of the Al-Mg-Si type in producing automotive bodies, among other parts.

In this technology, the Al-Mg-Si alloy sheet is formed into an element of an auto body after solution treatment followed by natural aging into the T4 state. After forming, a hardening step through aging ("bake hardening" heat treatment) applied during the application or curing of the paints, imparts to the body the required properties.

The main difficulty raised by the use of aluminum alloys in automotive bodies is their insufficient formability. The formability of aluminum alloys, and in particular that of Al-Mg-Si alloys, therefore needs to be greatly improved.

Furthermore, aluminum alloy sheet suffers from low mechanical properties compared to steel sheet. Manufacturers are therefore interested in curing processes that, on the one hand, are efficient enough to impart to those sheets high mechanical properties and, on the other hand, that require fairly short treatment times and low temperatures to minimize processing costs.

SUMMARY OF THE INVENTION

The present invention relates to a process for the fabrication of aluminum alloy sheet having high formability, characterized in that an aluminum alloy sheet composed of 0.3 to 1.7% (by weight) Si, 0.01 to 1.2% Cu, 0.01 to 1.1% Mn, 0.4 to 1.4% Mg, less than 1.0% Fe and, the remainder, Al along with the inescapable impurities, is subjected to a continuous solution treatment for at least 3 seconds above 450° C., followed by cooling between 60° and 250° C. and a preaging process for 1 minute to 10 hours at the previous cooling temperature of between 60° and 250° C.

The alloy may contain one or more elements, selected from among Cr (between 0.04 and 0.4%), Zn (less than 0.25%), Zr (less than 0.4%) and Ti (less than 0.2%).

The ranges of composition imposed in the invention on the different alloying elements are justified by the following: Si improves the mechanical properties by forming an $Mg_2Si$ precipitate with Mg during the curing of the paint.

Its composition is selected in the 0.3–1.7% range by weight. Indeed, below 0.3% its effect is insufficient and above 1.7%, its formability after solution treatment decreases.

Mg improves the formability by forming a solid solution in the matrix after the solution treatment. Furthermore, it improves the mechanical properties by forming an $Mg_2Si$ precipitate with Si during the curing of the paint. Its composition is selected in the 0.4–1.4% range by weight. Indeed, below 0.4%, the increase in mechanical properties is not sufficient and above 1.4%, the formability after the solution treatment decreases.

Cu improves the mechanical properties by precipitating in particular the q' and S phases as well as GP (Guinier-Preston) zones, during the curing of the paint. Its composition is selected in the 0.01–1.2% range by weight. Indeed, below 0.01%, the increase in mechanical properties is not sufficient and above 1.2%, the corrosion resistance decreases.

Mn and Cr refine the grain size and the mechanical properties of the matrix. Their composition is selected in the 0.01–1.1% and the 0.04–0.4% range by weight, respectively. Indeed, at lower concentrations, their effect is insufficient and above the upper range, the formability after the solution treatment decreases.

Zn improves the mechanical properties. Zr and Ti refine the microstructure. Their composition is selected to be lower than 0.25%, 0.4% and 0.2% respectively. Above these values, the formability will be too low.

Fe, a general impurity in aluminum, must be kept below 1.0% by weight. Above this value, the beneficial effect of the invention might not be realized.

Other impurities are also limited to less than 0.5 wt %. Above this value, the benefits of the invention might not be realized.

Aluminum alloys of the Al-Mg-Si type are age-hardenable alloys: aging induces precipitation of a hardening phase which increases their mechanical properties. In the case of the Al-Mg-Si alloy, the precipitation sequence is as follows:

Supersaturated solid solution→GP zone→Intermediate phase→Stable phase

In the case of the solution/quenching/natural aging (T4) process, the aging creates GP zones with precipitates left in excess after the quench. These generate a clear improvement of the mechanical properties.

The curing of the paint induces an artificial aging which in turn induces the precipitation of an intermediate phase (age-hardening phase) which allows for the optimization of the mechanical properties of the alloy. The problem of this previous process lies in the distribution of precipitates which, because they are mainly concentrated in the GP zones during natural aging, prevent the subsequent precipitation of the intermediate phase during artificial aging and prohibit the achievement of optimal mechanical properties. It is also not possible to directly form the naturally aged alloy: The alignment of the GP zones with the matrix phase (Al) deteriorates the formability to the extent that it encourages failure along dislocations during deformation and ultimately the build up of stresses at grain boundaries.

The present invention was conceived after analyzing these different observations. It is characterized mainly by a permanent holding at a temperature above 60° C., without any incursion of room temperatures, during the time spent between the solution treatment and the final preaging.

The goal is to prevent the development of GP zones by maintaining the temperature above 60° C. until the end of the preaging. This is done in contrast with the previous process which included precisely incursions at room temperatures, either during the natural aging quench or until curing. These incursions were responsible for the development of GP zones.

Once the sheet is preaged, it can be exposed to normal temperature during forming and during painting and curing, without adverse effects on mechanical properties.

The fabrication process developed in the invention includes, after the traditional melting, casting, homogenization and rolling of the aluminum alloy described above, subjecting the alloy to a continuous solution treatment of more than 3 seconds at a temperature higher than 450° C., followed by a cooling step to a temperature between 60° and 250° C. at a rate higher than 100° C./mn, coiling at the cooling temperature (between 60° C. and 250° C.) and a preaging step between 1 minute and 10 hours at the same temperature.

The solution treatment improves the formability of the material by inducing the temporary solubilization of elements such as Si and Mg in the matrix. This later improves the mechanical properties through the formation of fine precipitates of $Mg_2Si$ during the subsequent curing step.

The solution heat treatment is applied for at least 3 seconds at a temperature above 450° C. Indeed, if the temperature and the time are below 450° C. and 3 seconds respectively, the dissolution of the elements (Si, Mg, etc.), and therefore the improvement in mechanical properties during the subsequent curing, will not be sufficient.

The cooling rate that follows the solution treatment must be set higher than 100° C./mn. indeed, below 100° C./mn, the precipitates are not as fine, resulting in a mediocre formability and an insufficient improvement in the mechanical properties during curing.

The final temperature, for this cooling rate, is selected within the 60°–250° C. range. Indeed, if it is lower than 60° C., GP zones will form and if it is higher than 250° C., a stable phase will develop that will negatively affect formability and mechanical properties.

Coiling of the material cooled between 60° and 250° C., in the same 60°–250° C. temperature range and the subsequent aging of 1 minute to 10 hours in the same 60°–250° C. temperature range are designed to allow the development of an intermediate phase, favorable to the mechanical properties and formability of the alloy.

If their temperature is below 60° C., GP zones form and if it is higher than 250° C., a stable phase will develop. Both will negatively affect formability and mechanical properties.

The preaging time is to be set between 1 minute and 10 hours. Indeed, below 1 minute, the intermediate phase is not precipitated enough and GP zones might form when the temperature eventually returns to normal. Above 10 hours, the overabundant intermediate phase pushes the mechanical properties too high, resulting in a lower formability.

Finally, the present invention applies not only to the continuous fabrication process mentioned above but also, with the same effects, to the classical discontinuous processes.

BRIEF DESCRIPTION OF THE INVENTION

DETAILED DESCRIPTION OF THE PREFERRED EMBODIMENTS

Figure 1:
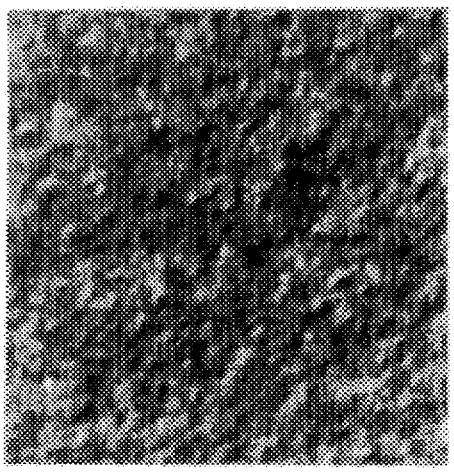
FIG. 1 shows the microstructure of an example of aluminum alloy sheet to which the invention applies.

The invention will be better understood by virtue of the following examples.

The aluminum alloys with the compositions shown in Table 1 were made into ingots. The ingots were homogenized, hot-rolled at 400° C. and cold-rolled, by means of the usual methods, to yield 1-mm-thick sheets. The sheets were subjected to a continuous solution treatment for 10 seconds at 560° C., followed by a heat treatment using the conditions shown in Table 2, followed by a preaging treatment between 1 minute and 10 hours at a chosen temperature: 60° C., 120° C., 180° C. or 250° C. Some of these sheets were also finally subjected to a curing treatment (1 hour at 180° C.). Others were not.

For the purpose of comparison, sheets were also prepared using the previous T4 process (solution and quench to room temperature).

Sheet samples were subjected to a tensile test, an Erichsen test and formability limit test (punch test). The results are given in Tables 3, 4, 5 and 6.

The tensile test was performed on tensile samples JIS No. 5. The Erichsen test was conducted according to JIS Z2247A (measure of the depth of the punch). The formability limit test consisted of driving a round punch 33 mm in diameter into a lubricated blank, of measuring the maximum blank diameter for which there was no failure and of computing the ratio of the maximum diameter to the punch diameter.

Table 3 gives the results obtained on sheets made of an alloy having a composition in the range described in the invention and subjected to a heat treatment as described in the invention. All exhibit high properties: elongation between 22.8 and 34.0%; tensile strength between 28.5 and 33.9 kg/mm$^2$; yield strength between 18.6 and 33.1 kg/mm$^2$; Erichsen index between 9.1 and 12.6 mm; formability limit ratio between 1.90 and 2.53. In particular, specimens that were not cured (heat treatments 1, 3, 5, 7) exhibit high ductility, high Erichsen indices and high formability limits. Cured samples (heat treatments 2, 4, 6, 8) exhibit lower ductilities, Erichsen indices and formability limits but noticeably higher tensile strength and yield strength. In other words, such sheets first offer a good formability for shaping into automotive body elements and acquire the required mechanical properties during curing.

Table 4 gives the results obtained on sheets made of an alloy having a composition in the range described in the invention and subjected to a heat treatment described in the invention. All exhibit characteristics noticeably lower than those of the sheets presented in Table 3 and processed according to the invention: elongation between 16.7 and 28.7%; tensile strength between 24.5 and 29.4 kg/mm$^2$; yield strength between 16.7 and 20.8 kg/mm$^2$; Erichsen index between 8.3 and 8.8 mm; formability limit between 1.6 and 1.87.

Tables 5 and 6 give the results obtained on sheets made of alloys having a composition outside the range described in the invention but subjected to the process described in the invention. Again, all exhibit characteristics sharply lower than those obtained on sheets having the composition and prepared by the process described in the invention: elongation between 16.4 and 28.6%; tensile strength between 21.2 and 29.1 kg/mm$^2$; yield strength between 15.9 and 21.6 kg/mm$^2$; Erichsen index between 8.2 and 8.8 mm; formability limit between 1.60 and 1.86.

Alloy C in Table 1 (Si 1.65%, Fe 0.08%, Mn 0.10%, Mg 1.38%, Zn 0.01%, Ti 0.02%, Al balance) subjected to heat treatment 3 from Table 2 (Solution treatment for 10 seconds at 560° C., cooling to 120° C., coiling at 120° C., preaging for 3 hours at 120° C., no curing) was selected as sample (a). The same alloy C subjected to heat treatment 4 from Table 2 (Heat treatment of sample (a) followed by curing for 1 hour at 180° C.) was selected as sample (b).

The same alloy C subjected to heat treatment 9 from Table 2 (Solution treatment for 10 seconds at 560° C., cooling to 20° C., coiling at 20° C., preaging for 3 hours at 120° C., no curing) was selected as sample (c). The same alloy C subjected to heat treatment 10 (Heat treatment of sample (c) followed by curing for 1 hour at 180° C.) was selected as sample (d).

Figure 2:
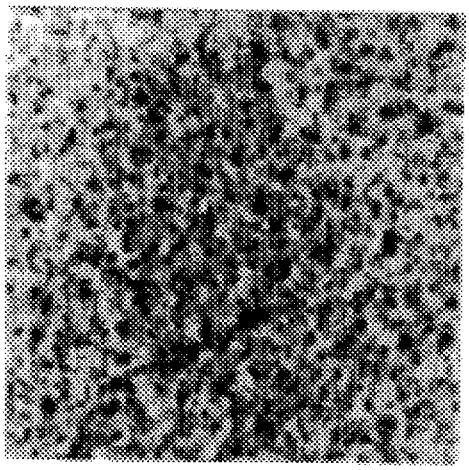
FIG. 2 shows another example of the microstructure of an aluminum alloy sheet to which the invention applies.

Samples (a), (b), (c), and (d) were photographed in plane {100} using an electronic microscope (magnification ×200,000). Micrographs are shown in FIGS. 1, 2, 3 and 4 respectively. We see that the preaged sample exhibits a fine precipitation of an $Mg_2Si$ intermediate phase (FIG. 1) and that the curing treatment makes the precipitation even finer (FIG. 2).

Figure 3:
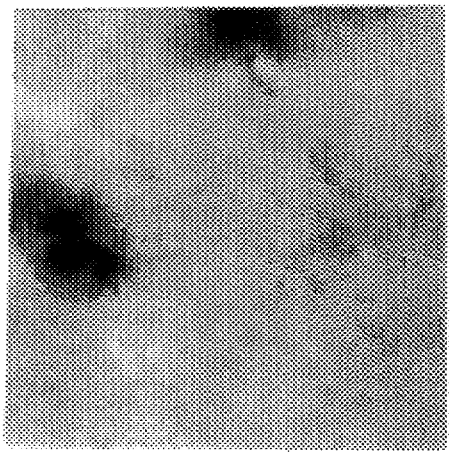
FIG. 3 shows the microstructure of an aluminum alloy sheet processed according to the previous state-of-the-art methods.
Figure 4:
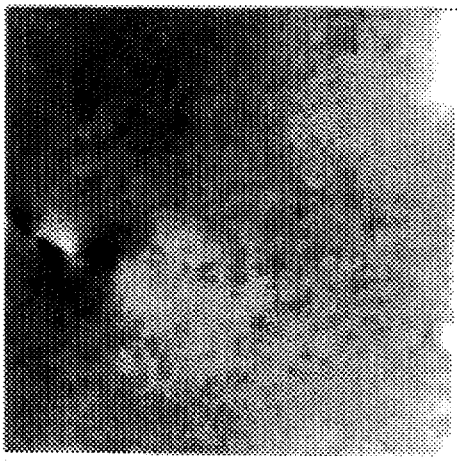
FIG. 4 shows another example of the microstructure of an aluminum alloy sheet processed according to the previous state-of-the-art methods.

FIG. 3 and 4 however show that cooling down to 20° C. prevents precipitation of the intermediate $Mg_2Si$ phase, even if a subsequent preaging treatment and a curing treatment are applied.

Thus, the process according to this invention offers great industrial promise in that it allows the manufacture of aluminum alloy sheet characterized by excellent formability and mechanical properties.

TABLE 1

| | | Alloy Composition (wt %) | | | | | | | | | |
|---|---|---|---|---|---|---|---|---|---|---|---|
| Alloy Symbol | | Si | Fe | Cu | Mn | Mg | Cr | Zn | Zr | Ti | AL |
| Present Invention | A | 0.35 | 0.11 | 0.20 | 0.05 | 0.43 | — | 0.02 | — | 0.01 | balance |
| | B | 0.79 | 0.10 | 0.82 | 0.05 | 0.10 | — | 0.01 | — | 0.03 | balance |
| | C | 1.65 | 0.06 | 1.11 | 0.10 | 1.88 | — | 0.01 | — | 0.02 | balance |
| | D | 0.81 | 0.07 | 0.80 | 0.15 | 0.80 | 0.05 | 0.03 | — | 0.02 | balance |
| | E | 0.81 | 0.19 | .081 | 0.35 | 1.01 | 0.35 | 0.03 | 0.13 | 0.13 | balance |
| Example for Comparison | F | 0.27 | 0.14 | — | — | 0.73 | — | — | — | — | balance |
| | G | 2.10 | 0.05 | 1.04 | 0.10 | 0.93 | — | — | — | — | balance |
| | H | 0.83 | 0.06 | 2.06 | 0.05 | 2.01 | — | — | — | — | balance |
| | I | 1.63 | 0.16 | — | — | 1.04 | 0.63 | — | — | — | balance |

TABLE 2

| | | Heat Treatment Method | | | | |
|---|---|---|---|---|---|---|
| | | Solution Heat Treat Condition | Cooling Treatment | Coiling Temp. | Pre-aging | Paint-bake Treatment |
| Present Invention | 1 | 560° C./10 sec. | 60° C. Cooled | 60° C. | 60° C./10 hrs. | |
| | 2 | 560° C./10 sec. | 60° C. Cooled | 60° C. | 60° C./10 hrs. | 180° C./1 hr. |
| | 3 | 560° C./10 sec. | 120° C. Cooled | 120° C. | 120° C./3 hrs. | |
| | 4 | 560° C./10 sec. | 120° C. Cooled | 120° C. | 120° C./3 hrs. | 180° C./1 hr. |
| | 5 | 560° C./10 sec. | 180° C. Cooled | 180° C. | 180° C./30 min. | |
| | 6 | 560° C./10 sec. | 180° C. Cooled | 180° C. | 180° C./30 min. | 180° C./1 hr. |
| | 7 | 560° C./10 sec. | 250° C. Cooled | 250° C. | 250° C./1 min. | |
| | 8 | 560° C./10 sec. | 250° C. Cooled | 250° C. | 250° C./1 min. | 180° C./1 hr. |
| Example for Comparison | 9 | 560° C./10 sec. | 20° C. Cooled | 20° C. | 120° C./3 hrs. | |
| | 10 | 560° C./10 sec. | 20° C. Cooled | 20° C. | 120° C./3 hrs. | 180° C./1 Hr. |
| | 11 | 560° C./10 sec. | 20° C. Cooled | 20° C. | 250° C./1 min. | |
| | 12 | 560° C./10 sec. | 20° C. Cooled | 20° C. | 250° C./1 min. | 180° C./1 hr. |
| | 13 | 560° C./10 sec. | T4 | — | — | — |
| | 14 | 560° C./10 sec. | T4 | — | — | 180° C./1 hr. |

TABLE 3

| | Heat Treatment Method | Alloy Symbol | Elongation (%) | Tensile Strength ($kg/mm^2$) | Yield Strength ($kg/mm^2$) | Ericksen Value (mm) | LDR |
|---|---|---|---|---|---|---|---|
| Present Invention | 1 | A | 33.7 | 28.7 | 18.7 | 12.5 | 2.52 |
| | 1 | B | 33.0 | 28.9 | 18.6 | 12.4 | 2.52 |
| | 1 | C | 32.5 | 28.4 | 19.2 | 12.4 | 2.48 |
| | 1 | D | 34.0 | 29.3 | 18.7 | 12.8 | 2.51 |
| | 1 | E | 31.9 | 30.1 | 20.1 | 12.1 | 2.82 |
| | 2 | A | 25.4 | 34.8 | 26.8 | 9.5 | 1.92 |
| | 2 | B | 24.6 | 35.0 | 27.6 | 9.4 | 1.91 |
| | 2 | C | 28.8 | 38.7 | 28.3 | 9.3 | 1.80 |
| | 2 | D | 28.4 | 37.2 | 28.9 | 9.3 | 1.80 |
| | 2 | E | 22.9 | 38.9 | 31.0 | 9.2 | 1.80 |
| | 3 | A | 33.5 | 28.5 | 18.3 | 12.4 | 2.52 |
| | 3 | B | 32.8 | 29.4 | 18.7 | 12.3 | 2.49 |
| | 3 | C | 32.8 | 29.8 | 19.8 | 12.3 | 2.48 |
| | 3 | D | 32.7 | 29.7 | 20.1 | 12.3 | 2.49 |
| | 3 | E | 31.8 | 30.5 | 21.8 | 12.1 | 2.31 |
| | 4 | A | 25.8 | 34.8 | 27.6 | 9.8 | 1.92 |
| | 4 | B | 24.9 | 35.6 | 28.6 | 9.4 | 1.91 |

TABLE 3-continued

| Heat Treatment Method | Alloy Symbol | Elongation (%) | Tensile Strength (kg/mm$^2$) | Yield Strength (kg/mm$^2$) | Ericksen Value (mm) | LDR |
|---|---|---|---|---|---|---|
| 4 | C | 23.7 | 36.4 | 29.8 | 9.3 | 1.80 |
| 4 | D | 28.8 | 37.6 | 31.2 | 9.4 | 1.91 |
| 4 | E | 29.7 | 38.7 | 32.4 | 9.4 | 1.90 |
| 5 | A | 34.0 | 28.7 | 19.8 | 12.6 | 2.58 |
| 5 | B | 32.9 | 29.0 | 19.7 | 12.4 | 2.52 |
| 5 | C | 33.7 | 28.7 | 20.6 | 12.5 | 2.58 |
| 5 | D | 32.7 | 29.9 | 21.4 | 12.4 | 2.52 |
| 5 | E | 31.8 | 30.4 | 22.5 | 12.1 | 2.80 |
| 6 | A | 25.7 | 35.2 | 30.7 | 9.6 | 1.92 |
| 6 | B | 25.8 | 34.8 | 29.8 | 9.6 | 1.93 |
| 6 | C | 24.6 | 30.7 | 31.5 | 9.4 | 1.91 |
| 6 | D | 23.8 | 38.0 | 32.7 | 9.3 | 1.90 |
| 6 | E | 22.8 | 39.0 | 33.1 | 9.1 | 1.90 |
| 7 | A | 33.7 | 28.6 | 21.0 | 12.5 | 2.54 |
| 7 | B | 32.9 | 29.7 | 20.4 | 12.4 | 2.52 |
| 7 | C | 32.5 | 28.7 | 22.7 | 12.3 | 2.49 |
| 7 | D | 32.8 | 30.1 | 20.7 | 12.3 | 2.48 |
| 7 | E | 32.7 | 30.2 | 22.7 | 12.4 | 2.61 |
| 8 | A | 25.6 | 34.8 | 28.9 | 9.6 | 1.92 |
| 8 | B | 25.7 | 35.6 | 28.5 | 9.6 | 1.92 |
| 8 | C | 24.8 | 36.4 | 28.4 | 9.5 | 1.91 |
| 8 | D | 23.7 | 37.5 | 29.5 | 9.3 | 1.90 |
| 8 | E | 23.7 | 38.6 | 36.7 | 9.3 | 1.90 |

TABLE 4

| | Heat Treatment Method | Alloy Symbol | Elongation (%) | Tensile Strength (kg/mm$^2$) | Yield Strength (kg/mm$^2$) | Ericksen Value (mm) | LDR |
|---|---|---|---|---|---|---|---|
| Example for Comparison | 9 | A | 28.7 | 26.7 | 16.7 | 8.8 | 1.87 |
| | 9 | B | 28.6 | 25.7 | 17.7 | 8.7 | 1.86 |
| | 9 | C | 27.6 | 28.0 | 17.8 | 8.7 | 1.85 |
| | 9 | D | 26.7 | 27.6 | 16.7 | 8.6 | 1.8 |
| | 9 | E | 24.9 | 28.4 | 16.8 | 8.5 | 1.82 |
| | 10 | A | 18.6 | 28.7 | 19.5 | 8.4 | 1.71 |
| | 10 | B | 19.7 | 27.9 | 20.8 | 8.4 | 1.76 |
| | 10 | C | 18.7 | 29.4 | 17.8 | 8.4 | 1.75 |
| | 10 | D | 16.7 | 28.7 | 19.6 | 8.3 | 1.61 |
| | 10 | E | 18.2 | 28.0 | 18.9 | 8.4 | 1.70 |
| | 11 | A | 27.6 | 27.0 | 17.6 | 8.8 | 1.86 |
| | 11 | B | 26.8 | 26.7 | 16.8 | 8.6 | 1.84 |
| | 11 | C | 27.5 | 26.5 | 16.7 | 8.7 | 1.85 |
| | 11 | D | 24.3 | 28.7 | 17.2 | 8.6 | 1.84 |
| | 11 | E | 27.6 | 27.6 | 18.9 | 8.6 | 1.83 |
| | 12 | A | 16.7 | 28.6 | 19.4 | 8.3 | 1.61 |
| | 12 | B | 18.4 | 27.6 | 20.6 | 8.3 | 1.62 |
| | 12 | C | 16.7 | 28.8 | 20.3 | 8.3 | 1.60 |
| | 12 | D | 18.5 | 26.7 | 19.6 | 8.4 | 1.70 |
| | 12 | E | 17.7 | 27.7 | 20.8 | 8.4 | 1.65 |
| | 13 | A | 25.7 | 24.5 | 16.7 | 8.6 | 1.84 |
| | 13 | B | 28.4 | 26.7 | 17.5 | 8.8 | 1.86 |
| | 13 | C | 27.6 | 24.6 | 18.8 | 8.7 | 1.85 |
| | 13 | D | 28.5 | 25.9 | 18.0 | 8.6 | 1.84 |
| | 13 | E | 28.4 | 28.4 | 16.7 | 8.8 | 1.85 |
| | 14 | A | 16.7 | 27.9 | 20.4 | 8.8 | 1.60 |
| | 14 | B | 18.6 | 28.6 | 18.9 | 8.4 | 1.70 |
| | 14 | C | 17.7 | 27.7 | 19.2 | 8.4 | 1.65 |
| | 14 | D | 16.5 | 20.5 | 17.8 | 8.8 | 1.61 |
| | 14 | E | 17.7 | 27.7 | 19.9 | 8.4 | 1.65 |

TABLE 5

| | Heat Treatment Method | Alloy Symbol | Elongation (%) | Tensile Strength (kg/mm$^2$) | Yield Strength (kg/mm$^2$) | Ericksen Value (mm) | LDR |
|---|---|---|---|---|---|---|---|
| Present Invention | 1 | F | 28.6 | 28.9 | 17.6 | 8.8 | 1.86 |
| | 1 | G | 24.3 | 24.8 | 16.9 | 8.5 | 1.82 |
| | 1 | H | 25.9 | 25.8 | 18.8 | 8.6 | 1.84 |

TABLE 5-continued

| Heat Treatment Method | Alloy Symbol | Elongation (%) | Tensile Strength (kg/mm²) | Yield Strength (kg/mm²) | Ericksen Value (mm) | LDR |
|---|---|---|---|---|---|---|
| 1 | I | 27.6 | 24.6 | 17.8 | 8.6 | 1.83 |
| 2 | F | 16.4 | 26.8 | 20.6 | 8.3 | 1.60 |
| 2 | G | 17.6 | 27.8 | 19.7 | 8.4 | 1.61 |
| 2 | H | 16.5 | 26.6 | 18.9 | 8.3 | 1.60 |
| 2 | I | 17.6 | 27.7 | 17.6 | 8.3 | 1.61 |
| 3 | F | 25.3 | 23.2 | 16.6 | 8.6 | 1.84 |
| 3 | G | 24.4 | 22.8 | 17.1 | 8.5 | 1.82 |
| 3 | H | 27.6 | 25.2 | 17.6 | 8.6 | 1.83 |
| 3 | I | 25.8 | 24.6 | 18.2 | 8.6 | 1.84 |
| 4 | F | 18.8 | 27.8 | 19.7 | 8.3 | 1.60 |
| 4 | G | 18.5 | 26.9 | 20.0 | 8.4 | 1.61 |
| 4 | H | 20.1 | 28.8 | 18.9 | 8.5 | 1.80 |
| 4 | I | 17.6 | 27.7 | 18.0 | 8.4 | 1.61 |
| 5 | F | 26.4 | 22.6 | 17.1 | 8.6 | 1.84 |
| 5 | G | 26.6 | 24.1 | 16.5 | 8.6 | 1.88 |
| 5 | H | 25.8 | 23.8 | 17.7 | 8.5 | 1.82 |
| 5 | I | 25.5 | 22.9 | 17.2 | 8.5 | 1.81 |
| 6 | F | 18.5 | 27.6 | 21.0 | 8.4 | 1.61 |
| 6 | G | 18.5 | 28.3 | 20.7 | 8.3 | 1.60 |
| 6 | H | 18.4 | 27.6 | 19.6 | 8.3 | 1.61 |
| 6 | J | 17.7 | 28.8 | 21.6 | 8.8 | 1.62 |
| 7 | F | 26.8 | 21.2 | 18.0 | 8.6 | 1.84 |
| 7 | G | 26.7 | 25.0 | 16.5 | 8.6 | 1.85 |
| 7 | H | 25.7 | 21.3 | 16.7 | 8.5 | 1.83 |
| 7 | I | 26.5 | 22.4 | 16.4 | 8.5 | 1.84 |

TABLE 6

| | Heat Treatment Method | Alloy Symbol | Elongation (%) | Tensile Strength (kg/mm²) | Yield Strength (kg/mm²) | Ericksen Value (mm) | LDR |
|---|---|---|---|---|---|---|---|
| Example for Comparison | 8 | F | 18.8 | 27.6 | 20.3 | 8.4 | 1.60 |
| | 8 | G | 19.3 | 28.3 | 18.9 | 8.5 | 1.62 |
| | 8 | H | 17.7 | 29.0 | 19.2 | 8.3 | 1.61 |
| | 8 | I | 18.6 | 27.6 | 18.7 | 8.4 | 1.60 |
| | 9 | F | 26.9 | 22.8 | 16.5 | 8.6 | 1.84 |
| | 9 | G | 28.0 | 21.6 | 17.0 | 8.7 | 1.85 |
| | 9 | H | 26.9 | 22.3 | 18.6 | 8.6 | 1.84 |
| | 9 | I | 27.3 | 22.0 | 16.7 | 8.5 | 1.83 |
| | 10 | F | 17.6 | 28.6 | 20.5 | 8.3 | 1.62 |
| | 10 | G | 19.9 | 27.8 | 19.6 | 8.4 | 1.61 |
| | 10 | H | 18.6 | 28.6 | 18.9 | 8.4 | 1.60 |
| | 10 | I | 19.6 | 27.7 | 19.9 | 8.5 | 1.62 |
| | 11 | F | 27.6 | 23.4 | 16.7 | 8.7 | 1.85 |
| | 11 | G | 27.2 | 22.5 | 16.3 | 8.7 | 1.84 |
| | 11 | H | 26.4 | 22.6 | 17.4 | 8.6 | 1.84 |
| | 11 | I | 25.8 | 24.3 | 17.9 | 8.5 | 1.82 |
| | 12 | F | 19.6 | 28.6 | 20.9 | 8.4 | 1.61 |
| | 12 | G | 18.8 | 29.1 | 20.5 | 8.4 | 1.60 |
| | 12 | H | 17.7 | 28.6 | 19.8 | 8.3 | 1.61 |
| | 12 | I | 19.6 | 27.7 | 18.9 | 8.5 | 1.65 |
| | 13 | F | 28.6 | 23.1 | 15.9 | 8.7 | 1.85 |
| | 13 | G | 27.6 | 22.2 | 16.8 | 8.6 | 1.84 |
| | 13 | H | 28.6 | 24.0 | 17.6 | 8.5 | 1.82 |
| | 13 | I | 25.5 | 23.3 | 16.8 | 8.5 | 1.84 |
| | 14 | F | 19.7 | 27.6 | 20.1 | 8.4 | 1.61 |
| | 14 | G | 16.8 | 28.8 | 19.7 | 8.2 | 1.60 |
| | 14 | H | 17.8 | 27.6 | 18.4 | 8.3 | 1.60 |
| | 14 | I | 19.6 | 26.6 | 19.7 | 8.4 | 1.61 |

What is claimed is:

1. A process for the fabrication of aluminum alloy sheet of high formability, characterized in that an aluminum alloy sheet composed of 0.3 to 1.7% (by weight) of Si, 0.01 to 1.2% Cu, 0.01 to 1.1% Mn, 0.4 to 1.4% Mg, less than 1.0% Fe and, the rest Al along with the inescapable impurities, is subjected to a continuous solution treatment for at least 3 seconds above 450° C., followed by cooling between 60° and 250° C. at a rate higher than 100° C./minute, followed by coiling at the same temperature in the 60° C.–250° C. range and a preaging process for a time between 1 minute and 10 hours at the previous cooling temperature of 60° to 250° C.

2. A process for the fabrication of aluminum alloy sheet according to claim 1, characterized in that the alloy contains one or more of the following elements, in the indicated range of composition: 0.04–0.4% Cr, less than 0.25% Zn, less than 0.4% Zr and less than 0.2% Ti.

* * * * *